US009873023B2

(12) United States Patent
Sakamine et al.

(10) Patent No.: US 9,873,023 B2
(45) Date of Patent: Jan. 23, 2018

(54) GOLF BALL

(71) Applicant: Dunlop Sports Co. Ltd., Kobe-shi, Hyogo (JP)

(72) Inventors: Ryota Sakamine, Kobe (JP); Hikaru Nagakura, Kobe (JP); Kazuyoshi Shiga, Kobe (JP); Takahiro Shigemitsu, Kobe (JP)

(73) Assignee: DUNLOP SPORTS CO. LTD., Kobe-shi, Hyogo (JP)

( * ) Notice: Subject to any disclaimer, the term of this patent is extended or adjusted under 35 U.S.C. 154(b) by 0 days.

(21) Appl. No.: 15/223,591

(22) Filed: Jul. 29, 2016

(65) Prior Publication Data

US 2017/0028261 A1 Feb. 2, 2017

(30) Foreign Application Priority Data

Jul. 31, 2015 (JP) ..... 2015-152347

(51) Int. Cl.

| | |
|---|---|
| ***A63B 37/02*** | (2006.01) |
| ***A63B 37/00*** | (2006.01) |
| *A63B 37/04* | (2006.01) |
| *A63B 37/06* | (2006.01) |

(52) U.S. Cl.

CPC ..... *A63B 37/0061* (2013.01); *A63B 37/0051* (2013.01); *A63B 37/0062* (2013.01); *A63B 37/02* (2013.01); *A63B 37/04* (2013.01); *A63B 37/06* (2013.01)

(58) Field of Classification Search

CPC ..... A63B 37/0051; A63B 37/02; A63B 37/04; A63B 37/06; C08K 5/0025

See application file for complete search history.

(56) References Cited

U.S. PATENT DOCUMENTS 4,955,966 A * 9/1990 Yuki ..... A63B 37/0003 473/357

6,139,447 A 10/2000 Ohama (Continued)

FOREIGN PATENT DOCUMENTS

JP 6-7481 A 1/1994

JP 11-128400 A 5/1999

(Continued)

OTHER PUBLICATIONS

Shore Durometer Conversion Chart—Thermal Tech Equipment Co. Inc.*

*Primary Examiner* — John E Simms, Jr.

(74) *Attorney, Agent, or Firm* — Birch, Stewart, Kolasch & Birch, LLP

(57) ABSTRACT

An object of the present invention is to provide a golf ball having an excellent initial velocity when being hit at a head speed of 50 m/sec and an improved initial velocity when being hit at a head speed of 40 m/sec. The present invention provides a golf ball comprising a spherical core and at least one cover covering the spherical core, wherein the spherical core is formed from a core rubber composition containing (a) a base rubber, (b) a co-crosslinking agent, (c) a crosslinking initiator and (x) a crosslinked rubber powder, and (x) the crosslinked rubber powder is formed from a rubber composition containing (a1) a base rubber, (b1) a co-crosslinking agent, (c1) a crosslinking initiator and (r) a resin component.

20 Claims, 1 Drawing Sheet

(56) References Cited

U.S. PATENT DOCUMENTS

| | | | | |
|---|---|---|---|---|
| 6,465,573 | B1 * | 10/2002 | Maruko | A63B 37/0003 473/373 |
| 6,494,794 | B1 | 12/2002 | Ohama | |
| 2002/0161119 | A1 * | 10/2002 | Obrecht | C08L 19/003 525/133 |
| 2003/0119605 | A1 * | 6/2003 | Hirau | A63B 37/0003 473/371 |
| 2008/0249251 | A1 * | 10/2008 | Wachi | C08L 19/003 525/274 |
| 2013/0172107 | A1 | 7/2013 | Higuchi et al. | |
| 2013/0172108 | A1 * | 7/2013 | Higuchi | A63B 37/0065 473/372 |
| 2013/0172120 | A1 * | 7/2013 | Shinohara | A63B 37/0058 473/377 |
| 2013/0320587 | A1 * | 12/2013 | Okabe | A63B 45/00 264/241 |

FOREIGN PATENT DOCUMENTS

| | | | | |
|---|---|---|---|---|
| JP | 2001-104518 | A | 4/2001 | |
| JP | 2003-079765 | * | 3/2003 | A63B 37/02 |
| JP | 2003-79765 | A | 3/2003 | |
| JP | 2008-253757 | A | 10/2008 | |
| JP | 2013-138839 | A | 7/2013 | |
| JP | 2013-138840 | A | 7/2013 | |

* cited by examiner

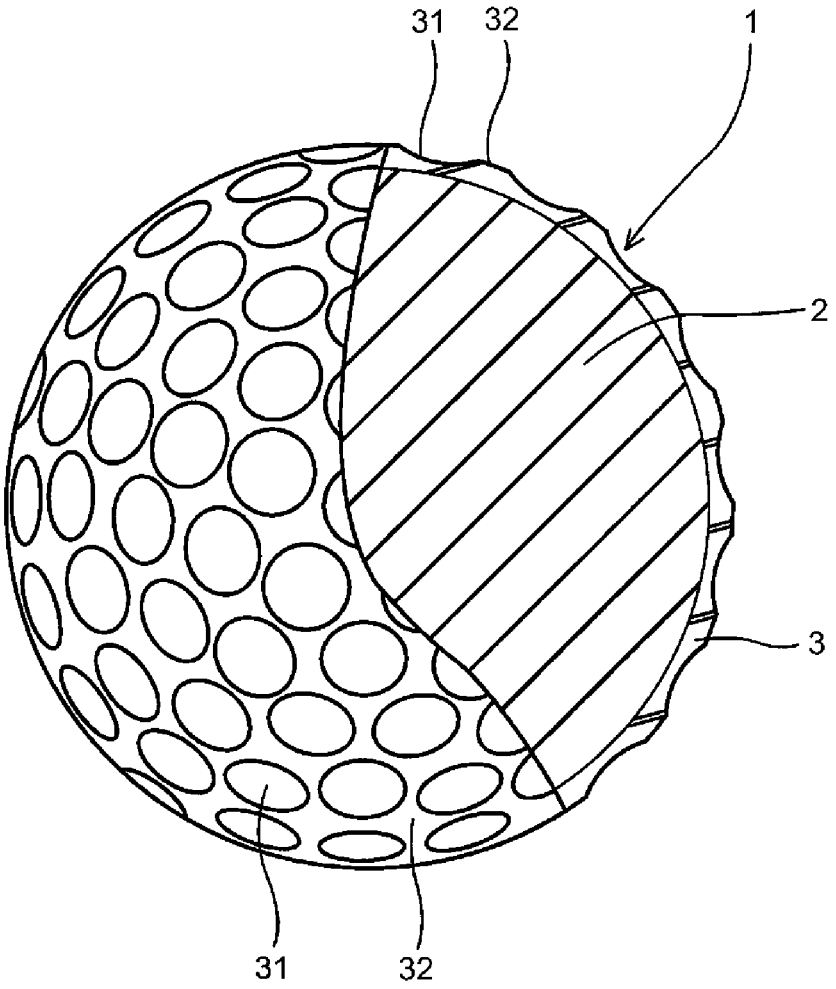
31
32
1
2
3
31
32

GOLF BALL

FIELD OF THE INVENTION

The present invention relates to a golf ball.

DESCRIPTION OF THE RELATED ART

A golf ball comprising a core and a cover covering the core has been proposed. As such a golf ball, a golf ball comprising a core formed from a rubber composition in which a vulcanized rubber powder is blended has been proposed.

For example, Japanese Patent Publication No. H06-7481 A discloses a golf ball having a single-layered construction or at least two-layered construction comprising a cover and an inner core composed of at least one layer, wherein the golf ball having a single-layered construction or the inner core of the golf ball having an at least two-layered construction contains a vulcanized rubber powder (refer to claim 1 in Japanese Patent Publication No. H06-7481 A). Japanese Patent Publication No. H11-128400 A discloses a golf ball having a single-layered construction or a golf ball having at least two-layered construction composed of at least one core layer and at least one cover layer, wherein the golf ball having the single-layered construction or the core of the golf ball having the at least two-layered construction includes a vulcanized molded product of a rubber composition, the rubber composition contains 5 to 60 parts by weight of a vulcanized rubber powder with respect to 100 parts by weight of a base rubber, and the base rubber is a mixture containing (A) a polybutadiene having a Mooney viscosity ranging from 40 to 65 and (B) a polybutadiene having a Mooney viscosity ranging from 20 to 35 in a weight ratio polybutadiene (A)/polybutadiene (B) ranging from 40/60 to 90/10 (refer to claim 1 in Japanese Patent Publication No. H11-128400 A).

Examples of the golf ball including a vulcanized rubber powder having a specific material include Japanese Patent Publications No. 2003-79765 A and No. 2008-253757 A. Japanese Patent Publication No. 2003-79765 A discloses a golf ball having an at least two-layered construction comprising a core and a cover, wherein the core contains 1 to 15 parts by mass of a vulcanized rubber powder crosslinked by a magnesium salt of an unsaturated carboxylic acid with respect to 100 parts by mass of a base rubber, and has a compression deformation amount ranging from 2.0 to 7.0 mm when applying a load from an initial load of 98 N to a final load of 1274 N to the core (refer to claim 1 in Japanese Patent Publication No. 2003-79765 A). Japanese Patent Publication No. 2008-253757 A discloses a golf ball comprising a heated molded product as a constituent member, wherein the heated molded product is obtained by vulcanizing a rubber composition in which a base rubber and an unsaturated carboxylic acid or a salt thereof are blended as essential components, and a vulcanized rubber powder from which soluble components have been removed by liquid washing is added in the rubber composition (refer to claim 1 in Japanese Patent Publication No. 2008-253757 A).

Japanese Patent Publication No. 2001-104518 A discloses a golf ball comprising a core and a cover, wherein the core is formed from a rubber composition containing a vulcanized rubber powder, and the core hardness and the cover hardness satisfy a specific relationship (refer to claim 4 and paragraph 0032 in Japanese Patent Publication No. 2001-104518 A). Japanese Patent Publications No. 2013-138839 A and No. 2013-138840 A disclose a golf ball comprising a core and a cover, wherein the core is formed from a rubber composition containing a rubber powder or a polyurethane powder, and the cover resin material has specific properties (refer to claim 1 in Japanese Patent Publication No. 2013-138839 A, and claim 1 in Japanese Patent Publication No. 2013-138840 A).

SUMMARY OF THE INVENTION

As a method for improving a flight performance of a golf ball, there is a method of improving the core resilience to increase the ball initial velocity at hitting. Examples of the method of improving the core resilience include a method of blending an organic sulfur compound into a core rubber composition. The optimum resilience of a golf ball varies depending on the head speed for hitting the golf ball. Therefore, the resilience performance of a golf ball should be adjusted according to the head speed for hitting the golf ball.

The present invention has been achieved in view of the above problems. An object of the present invention is to provide a golf ball having a large initial velocity when being hit both at a head speed of 50 m/sec and at a head speed of 40 m/sec, and particularly to provide a golf ball having a large initial velocity when being hit at a head speed of 40 m/sec.

The golf ball according to the present invention which has solved the above problem comprises a spherical core and at least one cover layer covering the spherical core, wherein the spherical core is formed from a core rubber composition containing (a) a base rubber, (b) a co-crosslinking agent, (c) a crosslinking initiator and (x) a crosslinked rubber powder, and (x) the crosslinked rubber powder is formed from a rubber composition containing (a1) a base rubber, (b1) a co-crosslinking agent, (c1) a crosslinking initiator and (r) a resin component.

The golf ball according to the present invention has a large initial velocity when being hit both at a head speed of 50 m/sec and at a head speed of 40 m/sec, and has a particularly large initial velocity when being hit at a head speed of 40 m/sec.

BRIEF DESCRIPTION OF THE DRAWINGS

FIG. 1 is a partially cutaway cross-sectional view of a golf ball of one embodiment according to the present invention.

DESCRIPTION OF THE PREFERRED EMBODIMENT

The present invention provides a golf ball comprising a spherical core and at least one cover layer covering the spherical core, wherein the spherical core is formed from a core rubber composition containing (a) a base rubber, (b) a co-crosslinking agent, (c) a crosslinking initiator and (x) a crosslinked rubber powder, and (x) the crosslinked rubber powder is formed from a rubber composition containing (a1) a base rubber, (b1) a co-crosslinking agent, (c1) a crosslinking initiator and (r) a resin component.

(x) The crosslinked rubber powder has a large hysteresis loss when it deforms. In addition, if the head speed at hitting is slow, the deformation amount of (x) the crosslinked rubber powder in the core is small. Thus, if the head speed at hitting is slow, the energy loss consumed by the deformation of (x) the crosslinked rubber powder is small, and the ball initial velocity at hitting is fast. Accordingly, if (x) the crosslinked rubber powder is contained, the difference between the ball initial velocity at a head speed of 50 m/sec and the ball initial velocity at a head speed of 40 m/sec can be decreased. As a result, the resultant golf ball has a fast initial velocity when being hit both at a head speed of 50 m/sec and at a head speed of 40 m/sec.

[Spherical Core]

The spherical core is formed from a core rubber composition containing (a) a base rubber, (b) a co-crosslinking agent, (c) a crosslinking initiator and (x) a crosslinked rubber powder.

((a) Base Rubber)

As (a) the base rubber, a natural rubber and/or a synthetic rubber can be used. For example, a polybutadiene rubber, a natural rubber, a polyisoprene rubber, a styrene polybutadiene rubber, an ethylene-propylene-diene rubber (EPDM), or the like can be used. These rubbers may be used solely, or at least two of these rubbers may be used in combination. Among them, typically preferred is a high cis-polybutadiene having a cis-1,4-bond in a proportion of 40 mass % or more, preferably 80 mass % or more, more preferably 90 mass % or more in view of its superior resilience.

The high-cis polybutadiene preferably has a 1,2-vinyl bond in an amount of 2 mass % or less, more preferably 1.7 mass % or less, and even more preferably 1.5 mass % or less. If the amount of the 1,2-vinyl bond is excessively high, the resilience may be lowered.

The high-cis polybutadiene is preferably a polybutadiene synthesized using a rare earth element catalyst. When a neodymium catalyst, which employs a neodymium compound that is a lanthanum series rare earth element compound, is used, a polybutadiene rubber having a high content of a cis-1,4 bond and a low content of a 1,2-vinyl bond is obtained with excellent polymerization activity. Such a polybutadiene rubber is particularly preferred.

The high-cis polybutadiene preferably has a Mooney viscosity ($ML_{1+4}$ (100° C.)) of 30 or more, more preferably 32 or more, even more preferably 35 or more, and preferably has a Mooney viscosity ($ML_{1+4}$ (100° C.)) of 140 or less, more preferably 120 or less, even more preferably 100 or less, and most preferably 80 or less. It should be noted that the Mooney viscosity ($ML_{1+4}$ (100° C.)) in the present invention is a value measured according to JIS K6300-1 (2013) using an L rotor under the conditions of: a preheating time of 1 minute; a rotor revolution time of 4 minutes; and a temperature of 100° C.

The high-cis polybutadiene preferably has a molecular weight distribution Mw/Mn (Mw: weight average molecular weight, Mn: number average molecular weight) of 2.0 or more, more preferably 2.2 or more, even more preferably 2.4 or more, and most preferably 2.6 or more, and preferably has a molecular weight distribution Mw/Mn of 6.0 or less, more preferably 5.0 or less, even more preferably 4.0 or less, and most preferably 3.4 or less. If the molecular weight distribution (Mw Mn) of the high-cis polybutadiene is excessively low, the processability deteriorates. If the molecular weight distribution (Mw/Mn) of the high-cis polybutadiene is excessively high, the resilience may be lowered. It is noted that the measurement of the molecular weight distribution is conducted by gel permeation chromatography ("HLC-8120GPC", available from Tosoh Corporation) using a differential refractometer as a detector under the conditions of column: GMHHXL (available from Tosoh Corporation), column temperature: 40° C., and mobile phase: tetrahydrofuran, and calculated by converting based on polystyrene standard.

((b) Co-Crosslinking Agent)

(b) The co-crosslinking agent has an action of crosslinking a rubber molecule by graft polymerization to a base rubber molecular chain. Preferable examples of (b) the co-crosslinking agent include an α,β-unsaturated carboxylic acid having 3 to 8 carbon atoms and/or a metal salt thereof. The α,β-unsaturated carboxylic acid used as (b) the co-crosslinking agent preferably has 3 to 8 carbon atoms, more preferably has 3 to 6 carbon atoms, even more preferably has 3 or 4 carbon atoms. Preferable examples of the α,β-unsaturated carboxylic acid having 3 to 8 carbon atoms include acrylic acid, methacrylic acid, fumaric acid, maleic acid and crotonic acid.

Examples of the metal ion constituting the metal salt of the α,β-unsaturated carboxylic acid having 3 to 8 carbon atoms include: a monovalent metal ion such as sodium, potassium and lithium; a divalent metal ion such as magnesium, calcium, zinc, barium and cadmium; a trivalent metal ion such as aluminum; and other metal ion such as tin and zirconium. The above metal component may be used solely or as a mixture of at least two of them. Among them, the divalent metal ion such as magnesium, calcium, zinc, barium and cadmium is preferably used as the metal component. This is because if the divalent metal salt of the α,β-unsaturated carboxylic acid having 3 to 8 carbon atoms is used, a metal crosslinking easily generates between the rubber molecules. Especially, as the divalent metal salt, a zinc salt of the α,β-unsaturated carboxylic acid having 3 to 8 carbon atoms is preferable, and zinc acrylate is more preferable, because the resilience of the obtained golf ball is enhanced by using them. The α,β-unsaturated carboxylic acid having 3 to 8 carbon atoms and/or the metal salt thereof may be used solely or as a mixture of at least two of them.

The amount of (b) the co-crosslinking agent is preferably 15 parts by mass or more, more preferably 20 parts by mass or more, and is preferably 50 parts by mass or less, more preferably 45 parts by mass or less, even more preferably 40 parts by mass or less, with respect to 100 parts by mass of (a) the base rubber. If the amount of (b) the co-crosslinking agent is less than 15 parts by mass, the amount of (c) the crosslinking initiator which will be described later must be increased such that the constituent member formed from the core rubber composition has an appropriate hardness, which tends to lower the resilience of the golf ball. On the other hand, if the amount of (b) the co-crosslinking agent exceeds 50 parts by mass, the constituent member formed from the core rubber composition becomes so hard that the shot feeling of the golf ball may be lowered.

((c) Crosslinking Initiator)

(c) The crosslinking initiator is blended to crosslink (a) the base rubber component. As (c) the crosslinking initiator, an organic peroxide is suitable. Specific examples of the organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. These organic peroxides may be used solely or as a mixture of at least two of them. Among them, dicumyl peroxide is preferably used.

The amount of (c) the crosslinking initiator is preferably 0.2 part by mass or more, more preferably 0.5 part by mass or more, and is preferably 5.0 parts by mass or less, more preferably 2.5 parts by mass or less, with respect to 100 parts by mass of (a) the base rubber. If the amount of (c) the crosslinking initiator is less than 0.2 part by mass, the constituent member formed from the core rubber composition is so soft that the resilience of the golf ball tends to be lowered. In addition, if the amount of (c) the crosslinking initiator exceeds 5.0 parts by mass, the amount of (b) the co-crosslinking agent described above must be decreased such that the constituent member formed from the core rubber composition has an appropriate hardness, which tends to lower the resilience or worsen the durability of the golf ball.

((d) Carboxylic Acid and/or Salt Thereof)

The core rubber composition may further contain (d) a carboxylic acid and/or a salt thereof. If (d) the carboxylic acid and/or the salt thereof is contained, the obtained spherical core has a greater degree of the outer-hard and inner-soft structure. Examples of (d) the carboxylic acid and/or the salt thereof include an aliphatic carboxylic acid, a salt of an aliphatic carboxylic acid, an aromatic carboxylic acid, and a salt of an aromatic carboxylic acid. (d) The carboxylic acid and/or the salt thereof may be used solely or as a mixture of at least two of them.

The aliphatic carboxylic acid may be a saturated aliphatic carboxylic acid (hereinafter sometimes referred to as "saturated fatty acid") or an unsaturated aliphatic carboxylic acid (hereinafter sometimes referred to as "unsaturated fatty acid"). In addition, the aliphatic carboxylic acid may have a branched structure or a cyclic structure. The carbon atom number of the saturated fatty acid is preferably 1 or more and 30 or less, more preferably 18 or less, even more preferably 13 or less. The carbon atom number of the unsaturated fatty acid is preferably 5 or more, more preferably 7 or more, even more preferably 9 or more, and is preferably 30 or less, more preferably 18 or less, even more preferably 13 or less. It should be noted that, (d) the aliphatic carboxylic acid and/or the salt thereof excludes (b) the α,β-unsaturated carboxylic acid having 3 to 8 carbon atoms and/or the metal salt thereof used as (b) the co-crosslinking agent.

Examples of the aromatic carboxylic acid include a carboxylic acid having a benzene ring in the molecule, and a carboxylic acid having an aromatic heterocycle in the molecule. The aromatic carboxylic acid may be used solely or as a mixture of at least two of them. Examples of the carboxylic acid having a benzene ring include an aromatic carboxylic acid having a carboxyl group directly bonding to a benzene ring, an aromatic-aliphatic carboxylic acid having an aliphatic carboxylic acid bonding to a benzene ring, a polynuclear aromatic carboxylic acid having a carboxyl group directly bonding to fused benzene rings, and a polynuclear aromatic-aliphatic carboxylic acid having an aliphatic carboxylic acid bonding to fused benzene rings. Examples of the carboxylic acid having an aromatic heterocycle include a carboxylic acid having a carboxyl group directly bonding to an aromatic heterocycle.

As (d) the aliphatic carboxylic acid salt or aromatic carboxylic acid salt, a salt of the above-mentioned aliphatic carboxylic acid or aromatic carboxylic acid can be used. Examples of the cation component of the salt include a metal ion, an ammonium ion, and an organic cation. Examples of the metal ion include a monovalent metal ion such as sodium, potassium, lithium and silver; a divalent metal ion such as magnesium, calcium, zinc, barium, cadmium, copper, cobalt, nickel and manganese; a trivalent metal ion such as aluminum and iron; and other metal ion such as tin, zirconium and titanium. The cation component may be used solely or as a mixture of at least two of them.

The organic cation is a cation having a carbon chain. The organic cation is not particularly limited, and examples thereof include an organic ammonium ion. Examples of the organic ammonium ion include a primary ammonium ion such as stearyl ammonium ion, hexyl ammonium ion, octyl ammonium ion and 2-ethylhexyl ammonium ion; a secondary ammonium ion such as dodecyl (laury) ammonium ion and octadecyl (stearyl) ammonium ion; a tertiary ammonium ion such as trioctyl ammonium ion; a quaternary ammonium ion such as dioctyl dimethyl ammonium ion and distearyl dimethyl ammonium ion. These organic cations may be used solely or as a mixture of at least two of them.

Examples of (d) the aliphatic carboxylic acid and/or the salt thereof include a saturated fatty acid and/or a salt thereof, and an unsaturated fatty acid and/or a salt thereof. The saturated fatty acid and/or the salt thereof is preferred, caprylic acid (octanoic acid), pelargonic acid (nonanoic acid), capric acid (decanoic acid), lauric acid, myristic acid, palmitic acid, stearic acid, behenic acid, and/or potassium salt, magnesium salt, calcium salt, aluminum salt, zinc salt, iron salt, copper salt, nickel salt, cobalt salt thereof are more preferred. Preferable examples of the unsaturated fatty acid and/or the salt thereof include palmitoleic acid, oleic acid, linoleic acid, arachidonic acid, and/or potassium salt, magnesium salt, calcium salt, aluminum salt, zinc salt, iron salt, copper salt, nickel salt, cobalt salt thereof.

Preferable examples of (d) the aromatic carboxylic acid and/or the salt thereof include benzoic acid, butylbenzoic acid, anisic acid (methoxybenzoic acid), dimethoxybenzoic acid, trimethoxybenzoic acid, dimethylaminobenzoic acid, chlorobenzoic acid, dichlorobenzoic acid, trichlorobenzoic acid, acetoxybenzoic acid, biphenylcarboxylic acid, naphthalenecarboxylic acid, anthracenecarboxylic acid, furancarboxylic acid, thenoic acid, and/or potassium salt, magnesium salt, calcium salt, aluminum salt, zinc salt, iron salt, copper salt, nickel salt, cobalt salt thereof.

The amount of (d) the carboxylic acid and/or the salt thereof is preferably 0.5 part by mass or more, more preferably 1.0 part by mass or more, even more preferably 1.5 parts by mass or more, and is preferably 40 parts by mass or less, more preferably 35 parts by mass or less, even more preferably 30 parts by mass or less, with respect to 100 parts by mass of (a) the base rubber. If the amount of (d) the carboxylic acid and/or the salt thereof is 0.5 part by mass or more, the spherical core has a greater degree of the outer-hard and inner-soft structure, and if the amount of (d) the carboxylic acid and/or the salt thereof is 40 parts by mass or less, lowering in the core hardness is suppressed, and thus the resilience of the golf ball is better.

It should be noted that there are cases where the surface of the compound used as the co-crosslinking agent is treated with zinc stearate or the like to improve the dispersibility to the rubber. In the present invention, in the case of using the co-crosslinking agent whose surface is treated with zinc stearate or the like, the amount of zinc stearate or the like used as a surface treating agent is included in the amount of (d) the carboxylic acid and/or the salt thereof. For example, if 25 parts by mass of zinc acrylate whose surface treatment amount with zinc stearate is 10 mass % is used, the amount of zinc stearate is 2.5 parts by mass and the amount of zinc acrylate is 22.5 parts by mass. Thus, the amount of 2.5 parts by mass is counted as the amount of (d) the carboxylic acid and/or the salt thereof.

In the case of using (d) the carboxylic acid and/or the salt thereof, a metal salt of an α,β-unsaturated carboxylic acid having 3 to 8 carbon atoms is preferably used as the co-crosslinking agent. In the case that (d) the carboxylic acid and/or the salt thereof is used together with an α,β-unsaturated carboxylic acid having 3 to 8 carbon atoms that is used as the co-crosslinking agent, (e) a metal compound is preferably further contained.

((e) Metal Compound)

(e) The metal compound is not particularly limited, as long as it can neutralize (b) the α,β-unsaturated carboxylic acid having 3 to 8 carbon atoms in the rubber composition. Examples of (e) the metal compound include: a metal hydroxide such as magnesium hydroxide, zinc hydroxide, calcium hydroxide, sodium hydroxide, lithium hydroxide, potassium hydroxide, and copper hydroxide; a metal oxide such as magnesium oxide, calcium oxide, zinc oxide, and copper oxide; and a metal carbonate such as magnesium carbonate, zinc carbonate, calcium carbonate, sodium carbonate, lithium carbonate, and potassium carbonate. As (e) the metal compound, a divalent metal compound is preferable, a zinc compound is more preferable. This is because the divalent metal compound reacts with the α,β-unsaturated carboxylic acid having 3 to 8 carbon atoms and forms a metal crosslinking. In addition, if the zinc compound is used, the golf ball having better resilience is obtained. (d) The metal compound may be used solely or as a mixture of at least two of them.

((f) Organic Sulfur Compound)

The core rubber composition preferably further contains (f) an organic sulfur compound. If (f) the organic sulfur compound is contained, the obtained spherical core has better resilience. Examples of (f) the organic sulfur compound include thiophenols, thionaphthols, polysulfides, thiurams, thiocarboxylic acids, dithiocarboxylic acids, sulfenamides, dithiocarbamates, and thiazoles. From the viewpoint of increasing the hardness distribution of the spherical core, (f) the organic sulfur compound is preferably an organic sulfur compound having a thiol group (—SH) or a metal salt thereof, and more preferably thiophenols, thionaphthols or metal salts thereof. (f) The organic sulfur compound may be used solely or as a mixture of at least two of them.

As (f) the organic sulfur compound, thiophenols and/or metal salts thereof, thionaphthols and/or metal salts thereof, diphenyldisulfides, and thiuramdisulfides are preferable, 2,4-dichlorothiophenol, 2,6-difluorothiophenol, 2,6-dichlorothiophenol, 2,6-dibromothiophenol, 2,6-diiodothiophenol, 2,4,5-trichlorothiophenol, pentachlorothiophenol, pentabromothiophenol, 1-thionaphthol, 2-thionaphthol, diphenyldisulfide, bis(2,6-difluorophenyl)disulfide, bis(2,6-dichlorophenyl)disulfide, bis(2,6-dibromophenyl)disulfide, bis(2,6-diiodophenyl)disulfide, and bis(pentabromophenyl)disulfide are more preferable.

The amount of (f) the organic sulfur compound is preferably 0.05 part by mass or more, more preferably 0.1 part by mass or more, and is preferably 5.0 parts by mass or less, more preferably 2.0 parts by mass or less, with respect to 100 parts by mass of (a) the base rubber. If the amount of (f) the organic sulfur compound is 0.05 part by mass or more, the obtained golf ball has better resilience, and if the amount of (f) the organic sulfur compound is 5.0 parts by mass or less, the compression deformation amount of the obtained golf ball does not become excessively large, and thus lowering in the resilience is suppressed.

((x) Crosslinked Rubber Powder)

The core rubber composition contains (x) a crosslinked rubber powder. The crosslinked rubber is a rubber where rubber molecular chains are crosslinked to form a three dimensional net structure such that no plastic deformation occurs.

The Lupke type rebound resilience of (x) the crosslinked rubber powder is preferably 30% or more, more preferably 45% or more, even more preferably 50% or more, and is preferably 99% or less, more preferably 85% or less, even more preferably 80% or less. If the Lupke type rebound resilience is 30% or more, lowering in the ball initial velocity at hitting can be suppressed, and if the Lupke type rebound resilience is 99% or less, the golf ball has better durability.

The hardness (Hp) of (x) the crosslinked rubber powder is preferably 15 or more, more preferably 20 or more, even more preferably 23 or more, and is preferably 95 or less, more preferably 92 or less, even more preferably 90 or less in Shore C hardness. If the particle hardness (Hp) is 15 or more, the crosslinking density of the base rubber increases, and the crosslinking of (x) the crosslinked rubber powders is suppressed when molding the core, thus the effect by (x) the crosslinked rubber powder is enhanced. If the particle hardness (Hp) is 95 or less, the golf ball has better shot feeling.

The volume average particle size of (x) the crosslinked rubber powder is preferably 50 μm or more, more preferably 300 μm or more, even more preferably 400 μm or more, and is preferably 900 μm or less, more preferably 750 μm or less, even more preferably 700 μm or less. If the volume average particle size falls within the above range, (x) the crosslinked rubber powder is easily dispersed in the matrix material, and thus the effect by (x) the crosslinked rubber powder is enhanced.

The amount of (x) the crosslinked rubber powder is preferably 2.1 part by mass or more, more preferably 3.0 parts by mass or more, even more preferably 4.0 parts by mass or more, and is preferably 30 parts by mass or less, more preferably 20 parts by mass or less, even more preferably 10 parts by mass or less, with respect to 100 parts by mass of (a) the base rubber. If the amount of (x) the crosslinked rubber powder is 2.1 part by mass or more, the effect by (x) the crosslinked rubber powder is enhanced, and if the amount of (x) the crosslinked rubber powder is 30 parts by mass or less, lowering in the resilience of the spherical core is suppressed.

(x) The crosslinked rubber powder is formed from a rubber composition containing (a1) a base rubber, (b1) a co-crosslinking agent, (c1) a crosslinking initiator and (r) a resin component.

The softening point of (r) the resin component is preferably 90° C. or less, more preferably 87° C. or less, even more preferably 85° C. or less. If the softening point is 90° C. or less, the resin component has better dispersibility to the base rubber when kneading the rubber composition. The softening point is measured with a thermomechanical analysis apparatus in a penetration mode (probe tip: cylindrical shape, diameter of 1 mm, length of 0.5 mm). It should be noted that the test piece is a film, and has a length of 10 mm, a thickness of 0.5 mm and a width of 3 mm.

(r) The resin component is preferably a thermoplastic resin. If (r) the resin component is a thermoplastic resin, (r) the resin component has better dispersibility in (a1) the base rubber. As a result, it becomes easier to uniformly disperse (r) the resin component when kneading the rubber composition for forming the crosslinked rubber powder.

In addition, (r) the resin component is preferably a copolymer including a monomer component having a benzene ring structure. If (r) the resin component has a benzene ring structure in the molecule, the resultant crosslinked rubber powder has enhanced stretchability, and thus the resultant spherical core has further enhanced resilience.

Preferable examples of (r) the resin component include a novolac type phenol resin, a coumarone-indene resin, a polystyrene resin, an acrylonitrile-butadiene-styrene copolymer (ABS) resin, an acrylonitrile-styrene (AS) resin, and a polyethylene terephthalate (PET) resin.

The novolac type phenol resin is a thermoplastic resin obtained by causing a reaction between a phenol or a derivate thereof and an aldehyde or a derivate thereof in the presence of an acidic catalyst.

The phenol or the derivate thereof is not particularly limited, and a monohydric phenol or a polyhydric phenol may be used. Examples of the monohydric phenol include phenol; an alkylphenol such as cresol, xylenol, ethylphenol, propylphenol, butylphenol, pentylphenol, octylphenol and nonylphenol, a halogenated phenol such as fluorophenol, chlorophenol, bromophenol and iodophenol, cumylphenol, phenylphenol, aminophenol, nitrophenol, dinitrophenol, trinitrophenol, and naphthol. Examples of the polyhydric phenol include resorcin, alkylresorcin, pyrogallol, catechol, alkylcatechol, hydroquinone, alkylhydroquinone, phloroglucin, bisphenol A, bisphenol F, bisphenol S, and dihydroxynaphthalene. The phenol or the derivate thereof may be used solely or as a mixture of at least two of them.

The aldehyde or the derivate thereof is not particularly limited, and examples thereof include formaldehyde, paraformaldehyde, trioxane, acetaldehyde, propionaldehyde, polyoxymethylene, chloral, hexamethylenetetramine, furfural, glyoxal, n-butylaldehyde, caproaldehyde, allylaldehyde, benzaldehyde, crotonaldehyde, acrolein, tetraoxymethylene, phenylacetaldehyde, o-tolualdehyde, and salicylaldehyde. The aldehyde or the derivate thereof may be used solely or as a mixture of at least two of them.

The novolac type phenol resin is preferably the one modified by cashew oil or a derivate thereof. The cashew oil or the derivate thereof contains cardanol, cardol and the like which are phenol compounds having a long chain alkenyl group. Thus, if the novolac type phenol resin is modified by the cashew oil or the derivate thereof, the resultant novolac type phenol resin has a long chain alkyl group or alkenyl group. Such a cashew oil modified novolac type phenol resin has excellent compatibility with rubber. Moreover, in the case of having the alkenyl group, the alkenyl group reacts with the double bond of the base rubber, and the resultant rubber powder has enhanced elasticity.

The coumarone-indene resin is a copolymer that includes coumarone or a derivate thereof and indene or a derivate thereof as monomer components and a total amount of coumarone or the derivate thereof and indene or the derivate thereof in the whole monomer components is 50 mass % or more. Examples of the coumarone or the derivate thereof include coumarone and methyl coumarone. The amount of the coumarone or the derivate thereof in the whole monomer component preferably ranges from 1 mass % to 20 mass %. Examples of the indene or the derivate thereof include indene and methyl indene. The amount of the indene or the derivate thereof in the whole monomer component preferably ranges from 40 mass % to 95 mass %. The coumarone-indene resin may further include other monomer component than coumarone or the derivate thereof and indene or the derivate thereof. Examples of the other monomer component include styrene, vinyl toluene, and dicyclopentadiene.

The amount of (r) the resin component is preferably 1 part by mass or more, more preferably 3 parts by mass or more, and is preferably 50 parts by mass or less, more preferably 10 parts by mass or less, with respect to 100 parts by mass of (a1) the base rubber. If the amount of (x) the crosslinked rubber powder is 1 part by mass or more, the effect due to the use of (x) the crosslinked rubber powder is enhanced, and if the amount of (x) the crosslinked rubber powder is 50 parts by mass or less, lowering in the resilience of the spherical core is suppressed.

Examples of (a1) the base rubber include (a) the base rubber used for the above core rubber composition, and polybutadiene rubber, natural rubber, polyisoprene rubber, styrene polybutadiene rubber, ethylene-propylene-diene rubber (EPDM) are preferably used.

Examples of (b1) the co-crosslinking agent include (b) the co-crosslinking agent used for the above core rubber composition. As (b1) the co-crosslinking agent, a zinc salt of an α,β-unsaturated carboxylic acid having 3 to 8 carbon atoms is preferred, zinc acrylate or zinc methacrylate is more preferred.

Examples of (c1) the crosslinking initiator include (c) the crosslinking initiator used for the above core rubber composition, and dicumyl peroxide, 1,1-bis(t-butylperoxy)-3,3,5-trimethylcyclohexane, 2,5-dimethyl-2,5-di(t-butylperoxy) hexane and di-t-butyl peroxide are preferable.

The rubber composition for forming (x) the crosslinked rubber powder may further contain (f1) an organic sulfur compound. Examples of (f1) the organic sulfur compound include (f) the organic sulfur compound used for the above core rubber composition, and 2-thionaphthol, diphenyldisulfide, 2,6-dichlorothiophenol, 2,6-dibromothiophenol, pentachlorothiophenol and pentabromothiophenol are preferable.

The rubber composition for forming (x) the crosslinked rubber powder may further contain (e1) a metal compound. Examples of (e1) the metal compound include: a metal hydroxide such as magnesium hydroxide, zinc hydroxide, calcium hydroxide, sodium hydroxide, lithium hydroxide, potassium hydroxide, and copper hydroxide; a metal oxide such as magnesium oxide, calcium oxide, zinc oxide, and copper oxide; and a metal carbonate such as magnesium carbonate, zinc carbonate, calcium carbonate, sodium carbonate, lithium carbonate, and potassium carbonate.

The rubber composition for forming (x) the crosslinked rubber powder may further contain additives such as a pigment, a filler for adjusting weight, an antioxidant (e.g. 2,5-di-t-butylhydroquinone), a peptizing agent, a softener, and the like.

(x) The crosslinked rubber powder may be prepared by pulverizing or grinding a rubber sheet formed from the rubber composition.

(Additive)

The core rubber composition used for the present invention may further contain additives such as a pigment, a filler for adjusting weight, an antioxidant (e.g. 2,5-di-t-butylhydroquinone), a peptizing agent, a softener, and the like, where necessary. In addition, the core rubber composition may contain a rubber powder which is obtained by pulverizing a golf ball core or offcuts produced when preparing a core.

Examples of the pigment blended in the core rubber composition include a white pigment, a blue pigment, and a purple pigment. As the white pigment, titanium oxide is preferably used. The type of titanium oxide is not particularly limited, but rutile type is preferably used because of the high opacity. In addition, the amount of titanium oxide is preferably 0.5 part by mass or more, more preferably 2 parts by mass or more, and is preferably 8 parts by mass or less, more preferably 5 parts by mass or less, with respect to 100 parts by mass of (a) the base rubber.

It is also preferred that the core rubber composition contains both a white pigment and a blue pigment. The blue pigment is blended in order to cause white color to be vivid, and examples thereof include ultramarine blue, cobalt blue, and phthalocyanine blue. In addition, examples of the purple pigment include anthraquinone violet, dioxazine violet, and methyl violet.

The amount of the blue pigment is preferably 0.001 part by mass or more, more preferably 0.05 part by mass or more, and is preferably 0.2 part by mass or less, more preferably 0.1 part by mass or less, with respect to 100 parts by mass of (a) the base rubber. If the amount of the blue pigment is less than 0.001 part by mass, blueness is insufficient, and the color looks yellowish. If the amount of the blue pigment exceeds 0.2 part by mass, blueness is excessively strong, and a vivid white appearance is not provided.

The filler blended in the rubber composition is mainly used as a weight adjusting agent for adjusting the weight of the golf ball obtained as a final product, and may be blended where necessary. Examples of the filler include an inorganic filler such as barium sulfate, calcium carbonate, magnesium oxide, tungsten powder, and molybdenum powder. The amount of the filler is preferably 0.5 part by mass or more, more preferably 1 part by mass or more, and is preferably 30 parts by mass or less, more preferably 25 parts by mass or less, even more preferably 20 parts by mass or less, with respect to 100 parts by mass of the base rubber. If the amount of the filler is less than 0.5 part by mass, it is difficult to adjust the weight, and if the amount of the filler exceeds 30 parts by mass, the weight proportion of the rubber component is decreased and thus the resilience tends to be lowered.

The amount of the antioxidant is preferably 0.1 part by mass or more and 1 part by mass or less with respect to 100 parts by mass of (a) the base rubber. In addition, the amount of the peptizing agent is preferably 0.1 part by mass or more and 5 parts by mass or less with respect to 100 parts by mass of (a) the base rubber.

The core rubber composition may be obtained by mixing and kneading (a) the base rubber, (b) the co-crosslinking agent, (c) the crosslinking initiator, (x) the crosslinked rubber powder, and where necessary, other additives. The kneading may be conducted, without any limitation, for example, using a conventional kneading machine such as a kneading roll, a banbury mixer and kneader.

The spherical core may be obtained by molding the kneaded rubber composition in a mold. The temperature for molding the spherical core is preferably 120° C. or more, more preferably 150° C. or more, even more preferably 160° C. or more, and is preferably 170° C. or less. If the molding temperature exceeds 170° C., the surface hardness of the core tends to be lowered. In addition, the molding pressure preferably ranges from 2.9 MPa to 11.8 MPa, and the molding time preferably ranges from 10 minutes to 60 minutes.

The center hardness Ho of the spherical core is preferably 35 or more, more preferably 40 or more, even more preferably 46 or more in Shore C hardness. If the spherical core has a center hardness Ho of 35 or more in Shore C hardness, the spherical core does not become excessively soft, and thus has better resilience. In addition, the center hardness Ho of the spherical core is preferably 90 or less, more preferably 80 or less, even more preferably 75 or less in Shore C hardness. If the spherical core has a center hardness Ho of 90 or less in Shore C hardness, the spherical core does not become excessively hard, and thus has better shot feeling.

The surface hardness Hs of the spherical core is preferably 65 or more, more preferably 70 or more, even more preferably 72 or more, and is preferably 95 or less, more preferably 90 or less, even more preferably 85 or less in Shore C hardness. If the spherical core has a surface hardness of 75 or more in Shore C hardness, the spherical core does not become excessively soft, and thus has better resilience. In addition, if the spherical core has a surface hardness of 95 or less in Shore C hardness, the spherical core does not become excessively hard, and thus has better shot feeling.

In one embodiment, the hardness difference (Hs−Ho) between the surface hardness Hs and the center hardness Ho of the spherical core is preferably −10 or more, more preferably −5 or more, even more preferably −3 or more, and is preferably 10 or less, more preferably 5 or less, even more preferably 3 or less in Shore D hardness. If the hardness difference (Hs−Ho) between the surface hardness Hs and the center hardness Ho of the spherical core falls within the above range, the effect of the spherical core is enhanced.

In another embodiment, the hardness difference (Hs−Ho) between the surface hardness Hs and the center hardness Ho of the spherical core is preferably 15 or more, more preferably 18 or more, even more preferably 20 or more, and is preferably 30 or less, more preferably 28 or less, even more preferably 27 or less in Shore C hardness. If the hardness difference is large, the golf ball showing a higher launch angle and a lower spin rate, thereby travelling a greater distance can be obtained.

The diameter of the spherical core is preferably 34.8 mm or more, more preferably 36.8 mm or more, even more preferably 38.8 mm or more, and is preferably 42.2 mm or less, more preferably 41.8 mm or less, even more preferably 41.2 mm or less, most preferably 40.8 mm or less. If the spherical core has a diameter of 34.8 mm or more, the thickness of the cover does not become excessively thick, and thus the resilience of the golf ball is better. On the other hand, if the spherical core has a diameter of 42.2 mm or less, the cover does not become excessively thin, and thus the cover functions better.

When the spherical core has a diameter in a range from 34.8 mm to 42.2 mm, the compression deformation amount (shrinking amount along the compression direction) of the spherical core when applying a load from an initial load of 98 N to a final load of 1275 N to the spherical core is preferably 2.0 mm or more, more preferably 2.8 mm or more, and is preferably 6.0 mm or less, more preferably 5.0 mm or less. If the compression deformation amount is 2.0 mm or more, the shot feeling is better, and if the compression deformation amount is 6.0 mm or less, the resilience is better.

[Cover]

The cover of the golf ball is formed from a cover composition containing a resin component. Examples of the resin component include an ionomer resin, a thermoplastic polyurethane elastomer having a trade name of "Elastollan (registered trademark)" available from BASF Japan Ltd., a thermoplastic polyamide elastomer having a trade name of "Pebax (registered trademark)" available from Arkema K. K., a thermoplastic polyester elastomer having a trade name of "Hytrel (registered trademark)" available from Du Pont-Toray Co., Ltd., and a thermoplastic styrene elastomer having a trade name of "Rabalon (registered trademark)" available from Mitsubishi Chemical Corporation.

Examples of the ionomer resin include a product obtained by neutralizing at least a part of carboxyl groups in a binary copolymer composed of an olefin and an α,β-unsaturated carboxylic acid having 3 to 8 carbon atoms with a metal ion; a product obtained by neutralizing at least a part of carboxyl groups in a ternary copolymer composed of an olefin, an α,β-unsaturated carboxylic acid having 3 to 8 carbon atoms and an α,β-unsaturated carboxylic acid ester with a metal ion; and a mixture thereof. The olefin is preferably an olefin having 2 to 8 carbon atoms. Examples of the olefin include ethylene, propylene, butene, pentene, hexene, heptene and octene, and ethylene is particularly preferred. Examples of the α,β-unsaturated carboxylic acid having 3 to 8 carbon atoms include acrylic acid, methacrylic acid, fumaric acid, maleic acid and crotonic acid, and acrylic acid or methacrylic acid is particularly preferred. In addition, examples of the α,β-unsaturated carboxylic acid ester include methyl ester, ethyl ester, propyl ester, n-butyl ester, isobutyl ester of acrylic acid, methacrylic acid, fumaric acid and maleic acid, and acrylic acid ester or methacrylic acid ester is particularly preferred. Among them, as the ionomer resin, a metal ion neutralized product of ethylene-(meth)acrylic acid binary copolymer or a metal ion neutralized product of ethylene-(meth)acrylic acid-(meth)acrylic acid ester ternary copolymer is preferred.

Specific examples of the ionomer resin include "Himilan (registered trademark) (e.g. Himilan 1555 (Na), Himilan 1557 (Zn), Himilan 1605 (Na), Himilan 1706 (Zn), Himilan 1707 (Na), Himilan AM3711 (Mg); and a ternary copolymer ionomer resin such as Himilan 1856 (Na) and Himilan 1855 (Zn))" available from Mitsui-Du Pont Polychemicals Co., Ltd.

Examples of the ionomer resin available from E.I. du Pont de Nemours and Company include "Surlyn (registered trademark) (e.g. Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), Surlyn AD8546 (Li); and a ternary copolymer ionomer resin such as Surlyn 8120 (Na), Surlyn 8320 (Na), Surlyn 9320 (Zn), Surlyn 6320 (Mg), HPF1000 (Mg), and HPF2000 (Mg))".

Examples of the ionomer resin available from DownMobil Chemical Corporation include "lotek (registered trademark) (e.g. lotek 8000 (Na), lotek 8030 (Na), lotek 7010 (Zn), lotek 7030 (Zn), and a ternary copolymer ionomer resin such as lotek 7510 (Zn), and lotek 7520 (Zn))".

It should be noted that Na, Zn, Li, Mg and the like described in the parentheses after the trade names of the ionomer resins indicate metal types of neutralizing metal ions of the ionomer resins. The ionomer resin may be used solely or as a mixture of at least two of them.

The cover composition for forming the cover of the golf ball according to the present invention preferably contains a thermoplastic polyurethane elastomer or an ionomer resin as the resin component. It is also preferred that when the ionomer resin is used, a thermoplastic styrene elastomer is used in combination. The amount of the polyurethane or ionomer resin in the resin component of the cover composition is preferably 50 mass % or more, more preferably 60 mass % or more, even more preferably 70 mass % or more.

In addition to the resin component, the cover composition may further contain a pigment component such as a white pigment (e.g. titanium oxide), a blue pigment and a red pigment, a weight adjusting agent such as zinc oxide, calcium carbonate and barium sulfate, a dispersant, an antioxidant, an ultraviolet absorber, a light stabilizer, a fluorescent material or fluorescent brightener, as long as they do not impair the performance of the cover.

The amount of the white pigment (e.g. titanium oxide) is preferably 0.5 part or more, more preferably 1 part or more, and is preferably 10 parts or less, more preferably 8 parts or less, with respect to 100 parts by mass of the resin component constituting the cover. If the amount of the white pigment is 0.5 part by mass or more, it is possible to impart the opacity to the resultant cover. In addition, if the amount of the white pigment exceeds 10 parts by mass, the durability of the resultant cover may deteriorate.

The slab hardness of the cover composition is preferably set in accordance with the desired performance of the golf ball. For example, in case of a so-called distance golf ball which focuses on a flight distance, the cover composition preferably has a slab hardness of 50 or more, more preferably 55 or more, and preferably has a slab hardness of 80 or less, more preferably 70 or less in shore D hardness. If the cover composition has a slab hardness of 50 or more, the obtained golf ball has a high launch angle and a low spin rate on driver shots and iron shots, and thus travels a great distance. In addition, if the cover composition has a slab hardness of 80 or less, the golf ball excellent in durability is obtained. Further, in case of a so-called spin golf ball which focuses on controllability, the cover composition preferably has a slab hardness of less than 50, and preferably has a slab hardness of 20 or more, more preferably 25 or more in shore D hardness. If the cover composition has a slab hardness of less than 50, the flight distance on driver shots can be increased by the core of the present invention, as well as the obtained golf ball readily stops on the green due to the high spin rate on approach shots. If the cover composition has a slab hardness of 20 or more, the abrasion resistance is enhanced. In case of a plurality of covers, the slab hardness of the cover composition constituting each layer may be identical or different, as long as it falls within the above range.

Examples of the method of molding the cover of the golf ball according to the present invention include a method which comprises molding the cover composition into a hollow shell, covering the core with a plurality of the hollow shells and performing compression molding (preferably a method which comprises molding the cover composition into a hollow half-shell, covering the core with two of the half-shells and performing compression molding); and a method which comprises injection molding the cover composition directly onto the core.

When molding the cover in a compression molding method, molding of the half shell can be performed by either the compression molding method or the injection molding method, and the compression molding method is preferred. Compression molding the cover composition into a half shell can be carried out, for example, under a pressure of 1 MPa or more and 20 MPa or less at a temperature of −20° C. or more and 70° C. or less relative to the flow beginning temperature of the cover composition. By performing the molding under the above conditions, the half shell having a uniform thickness can be formed. Examples of the method for molding the cover by using the half shell include a method which comprises covering the core with two of the half shells and then performing compression molding. Compression molding half shells into the cover can be carried out, for example, under a pressure of 0.5 MPa or more and 25 MPa or less at a temperature of −20° C. or more and 70° C. or less relative to the flow beginning temperature of the cover composition. By performing the molding under the above conditions, the golf ball cover having a uniform thickness can be formed.

In the case of injection molding the cover composition into the cover, the cover composition extruded in a pellet form may be used for injection molding, or the cover materials such as the base resin components and the pigment may be dry blended, followed by directly injection molding the blended material. It is preferred to use upper and lower molds having a hemi-spherical cavity and pimples for forming the cover, wherein a part of the pimples also serves as a retractable hold pin. When molding the cover by injection molding, the hold pin is protruded to hold the core, the cover composition is charged and then cooled to obtain the cover. For example, the cover composition heated at a temperature ranging from 200° C. to 250° C. is charged into a mold held under a pressure of 9 MPa to 15 MPa for 0.5 to 5 seconds, and after cooling for 10 to 60 seconds, the mold is opened to obtain the cover.

The concave portions called "dimple" are usually formed on the surface of the cover. The total number of dimples formed on the cover is preferably 200 or more and 500 or less. If the total number of dimples is less than 200, the dimple effect is hardly obtained. On the other hand, if the total number of dimples exceeds 500, the dimple effect is hardly obtained because the size of the respective dimple is small. The shape (shape in a plan view) of the dimples formed on the cover includes, without limitation, a circle; a polygonal shape such as a roughly triangular shape, a roughly quadrangular shape, a roughly pentagonal shape and a roughly hexagonal shape; and other irregular shape. These shapes may be employed solely, or at least two of them may be employed in combination.

The thickness of the cover is preferably 4.0 mm or less, more preferably 3.0 mm or less, even more preferably 2.0 mm or less. If the cover has a thickness of 4.0 mm or less, the resultant golf ball has better resilience or shot feeling. The thickness of the cover is preferably 0.3 mm or more, more preferably 0.5 mm or more, even more preferably 0.8 mm or more, most preferably 1.0 mm or more. If the cover has a thickness of less than 0.3 mm, the durability or wear resistance of the cover may be lowered. In the case that the golf ball comprises a plurality of covers, the total thickness of a plurality of covers preferably falls within the above range.

The golf ball body having the cover formed thereon is ejected from the mold, and is preferably subjected to surface treatments such as deburring, cleaning and sandblast where necessary. In addition, if desired, a paint film or a mark may be formed. The thickness of the paint film is not particularly limited, and is preferably 5 μm or more, more preferably 7 μm or more, and is preferably 50 μm or less, more preferably 40 μm or less, even more preferably 30 μm or less. If the thickness of the paint film is less than 5 μm, the paint film is easy to wear off due to the continued use of the golf ball, and if the thickness of the paint film exceeds 50 μm, the dimple effect is reduced and thus the flight performance of the golf ball may be lowered.

The golf ball preferably has a diameter ranging from 40 mm to 45 mm. In light of satisfying the regulation of US Golf Association (USGA), the diameter is most preferably 42.67 mm or more. In light of prevention of air resistance, the diameter is more preferably 44 mm or less, and most preferably 42.80 mm or less. In addition, the golf ball preferably has a mass of 40 g or more and 50 g or less. In light of obtaining greater inertia, the mass is more preferably 44 g or more, and most preferably 45.00 g or more. In light of satisfying the regulation of USGA, the mass is most preferably 45.93 g or less.

When the golf ball has a diameter in a range from 40 mm to 45 mm, the compression deformation amount (shrinking amount along the compression direction) of the golf ball when applying a load from an initial load of 98 N to a final load of 1275 N to the golf ball is preferably 2.0 mm or more, more preferably 2.4 mm or more, even more preferably 2.5 mm or more, most preferably 2.8 mm or more, and is preferably 5.0 mm or less, more preferably 4.5 mm or less. If the compression deformation amount is 2.0 mm or more, the golf ball does not become excessively hard, and thus has better shot feeling. On the other hand, if the compression deformation amount is 5.0 mm or less, the golf ball has better resilience.

The construction of the golf ball according to the present invention is not particularly limited, as long as the golf ball comprises a spherical core and at least one cover layer covering the spherical core. The spherical core preferably has a single-layered construction. Unlike the multi-layered spherical core, the single-layered spherical core does not have an energy loss at the interface of the multi-layered construction when being hit, and thus has better resilience. In addition, the cover may have a single-layered construction, or a multi-layered construction composed of at least two layers. The golf ball according to the present invention includes, for example, a two-piece golf ball comprising a spherical core and a single-layered cover disposed around the spherical core, a multi-piece golf ball (including a three-piece golf ball) comprising a spherical core and at least two covers disposed around the spherical core, and a wound golf ball comprising a spherical core, a rubber thread layer formed around the spherical core and a cover disposed around the rubber thread layer. The present invention can be suitably applied to any one of the above golf balls.

FIG. 1 is a partially cutaway cross-sectional view of a golf ball 1 of one embodiment according to the present invention. The golf ball 1 has a spherical core 2, and a cover 3 covering the spherical core 2. A plurality of dimples 31 are formed on the surface of the cover 3. Other portions than dimples 31 on the surface of the golf ball 1 are land 32. The golf ball 1 is provided with a paint layer and a mark layer outside the cover 3, but these layers are not depicted.

EXAMPLES

Next, the present invention will be described in detail by way of examples. However, the present invention is not limited to the examples described below. Various changes and modifications without departing from the spirit of the present invention are included in the scope of the present invention.

[Evaluation Method]

(1) Hardness (Shore C) of Crosslinked Rubber Powder

At least three of rubber sheets (thickness: 2 mm) used for producing the rubber powder were stacked on one another, and the hardness of the stack was measured with an automatic hardness tester (Digitest II, available from Bareiss company) using a testing device of "Shore C".

(2) Rebound Resilience

The rebound resilience test was conducted according to JIS K6255 (2013). A cylindrical test piece with a thickness of about 12 mm and a diameter of 28 mm was produced by punching the rubber sheet (thickness: 2 mm) for forming the rubber powder into a circular shape with a diameter of 28 mm, and stacking six of the obtained circular pieces. The test piece was stored at a temperature of 23° C. plus or minus 2° C. and a relative humidity of 50% plus or minus 5% for 12 hours. The rebound resilience of the produced test piece was measured with a Lupke type rebound resilience tester (available from Ueshima Seisakusho Co., Ltd.). The planar part of the stacked test piece produced above was held by a mechanical fixing method, and the measurement was carried out at a temperature of 23° C., relative humidity of 50%, impact end diameter of 12.50 mm plus or minus 0.05 mm, impact mass of 0.35 kg plus or minus 0.01 kg and impact speed of 1.4 m/s plus or minus 0.01 m/s.

(3) Average Particle Size of Crosslinked Rubber Powder

The volume based average particle size of the crosslinked rubber powder was measured with a laser diffraction/scattering particle size distribution analyzer (type: LMS-2000e, available from Seishin Enterprise Co., Ltd.).

(4) Core Hardness (Shore C)

The hardness measured at the surface of the core was adopted as the surface hardness of the core. In addition, the core was cut into two hemispheres to obtain a cut plane, and the hardness at the central point thereof and the hardness at predetermined distances from the central point thereof were measured. It should be noted that the hardness was measured at four points at predetermined distances from the central point of the cut plane, and the average value thereof was adopted as the hardness of the core at the predetermined distance. The hardness was measured with an automatic hardness tester (Digitest II, commercially available from Bareiss company) using a testing device of "Shore C".

(5) Compression Deformation Amount (mm)

The deformation amount along the compression direction of the core or the golf ball (shrinking amount along the compression direction of the core or the golf ball), when applying a load from an initial load of 98 N to a final load of 1275 N to the core or the golf ball, was measured.

(6) Slab Hardness (Shore D)

Sheets with a thickness of about 2 mm were produced by injection molding the cover composition. The sheets were stored at 23° C. for two weeks. At least three of these sheets were stacked on one another so as not to be affected by the measuring substrate on which the sheets were placed, and the hardness of the stack was measured with an automatic hardness tester (Digitest II, available from Bareiss company) using a testing device of "Shore D".

(7) Ball Initial Velocity on Driver Shots

A driver (trade name: XXIO, Shaft hardness: S, loft angel: 11°, available from Dunlop Sports Limited) was installed on a swing robot M/C available from Golf Laboratories, Inc. The golf ball was hit at a head speed of 40 m/sec or 50 m/sec, and the initial velocity (m/sec) right after hitting the golf ball was measured. This measurement was conducted twelve times for each golf ball, and the average value thereof was adopted as the measurement value for the golf ball.

[Preparation of Crosslinked Rubber Powder]

The rubber compositions having the formulations shown in Table 1 were kneaded with a kneading roll, and then heated at 170° C. for 20 minutes to obtain a rubber sheet (thickness: 2 mm). The obtained rubber sheet was pulverized with a frozen pulverizer to obtain the crosslinked rubber powder. It should be noted that the obtained rubber sheet has a uniform hardness.

TABLE 1

| Crosslinked rubber powder No. | | A | B | C | D | E | F |
|---|---|---|---|---|---|---|---|
| Formulation (parts by mass) | BR730 | 100 | 100 | 100 | 100 | 100 | 100 |
| | Zinc acrylate | 15 | 40 | 15 | 40 | 40 | 15 |
| | Zinc oxide | 5 | 5 | 5 | 5 | 5 | 5 |
| | Dicumyl peroxide | 0.16 | 0.9 | 0.16 | 0.9 | 0.9 | 0.16 |
| | 2-Thionaphthol | 0.1 | 0.1 | 0.1 | 0.1 | 0.1 | 0.1 |
| | Sumilite Resin PR 12686 | — | — | 5 | 5 | — | — |
| | Nitto Resin coumarone L-5 | — | — | — | — | 5 | — |
| | Haritack SE10 | — | — | — | — | — | 5 |
| Property | Hardness (Shore C) | 41.7 | 80.2 | 25.0 | 72.1 | 39.1 | 32.4 |
| | Lupke type rebound resilience (%) | 81 | 52 | 75 | 58 | 77 | 79 |
| | Volume average particle size (μm) | 640 | 640 | 640 | 640 | 640 | 640 |

BR730: high-cis polybutadiene (cis-1,4 bond amount = 96 mass %, 1,2-vinyl bond amount = 1.3 mass %, Moony viscosity ($ML_{1+4}$ (100° C.)) = 55, molecular weight distribution (Mw/Mn) = 3) JSR Corporation
Zinc acrylate: "ZN-DA90S" available from Nihon Joryu Kogyo Co., Ltd.
Zinc oxide: "Ginrei R" available from Toho Zinc Co., Ltd.
Dicumyl peroxide: "PERCUMYL (registered trademark) D" available from NOF Corporation
2-Thionaphthol: available from Tokyo Chemical Industry Co., Ltd.
Sumilite Resin (registered trademark) PR12686: cashew oil modified novolac type phenol resin (softening point: 85° C. or less) available from Sumitomo Bakelite Co., Ltd.
Nitto Resin (registered trademark) coumarone L-5: coumarone-indene resin (softening point: 20° C. or less) available from Nitto Chemical Co., Ltd.
Haritack SE10: rosin ester (softening point: 78° C. to 87° C.) available from Harima Chemicals Group, Inc.

[Production of Golf Ball]

(1) Production of Core

The rubber compositions having the formulations shown in Table 2 were kneaded with a kneading roll, and then heat-pressed in upper and lower molds, each having a hemispherical cavity, at 170° C. for 20 minutes to produce the spherical cores having a diameter of 40.0 mm. It should be noted that the formulation of the rubber composition was adjusted such that the ball initial velocity (m/sec) right after hitting the golf ball at a head speed of 50 m/sec was 71.00 m/sec.

TABLE 2

| Golf ball No. | | 1 | 2 | 3 | 4 | 5 | 6 | 7 |
|---|---|---|---|---|---|---|---|---|
| Rubber composition formulation (parts by mass) | BR730 | 100 | 100 | 100 | 100 | 100 | 100 | 100 |
| | Zinc acrylate | 24 | 24 | 26 | 25 | 25 | 24 | 25 |
| | Zinc oxide | 5 | 5 | 5 | 5 | 5 | 5 | 5 |
| | Dicumyl peroxide | 0.8 | 0.8 | 0.8 | 0.8 | 0.8 | 0.8 | 0.8 |
| | 2-Thionaphthol | 0.1 | 0.1 | 0.1 | 0.1 | 0.1 | 0.1 | 0.1 |
| | Crosslinked rubber powder No. A | — | — | — | — | 5 | — | — |
| | Crosslinked rubber powder No. B | — | — | — | — | — | 5 | — |
| | Crosslinked rubber powder No. C | 5 | — | — | — | — | — | — |
| | Crosslinked rubber powder No. D | — | 5 | — | — | — | — | — |

TABLE 2-continued

| Golf ball No. | | | 1 | 2 | 3 | 4 | 5 | 6 | 7 |
|---|---|---|---|---|---|---|---|---|---|
| | Crosslinked rubber powder No. E | | — | — | 5 | — | — | — | — |
| | Crosslinked rubber powder No. F | | — | — | — | — | — | — | 5 |
| | Barium sulfate | | Appropriate amount | Appropriate amount | Appropriate amount | Appropriate amount | Appropriate amount | Appropriate amount | Appropriate amount |
| Core | Hardness distribution (Shore C) | Center hardness Ho | 74.7 | 76.2 | 72.8 | 73.9 | 73.9 | 75.6 | 72.6 |
| | | 2.5 mm point hardness | 74.7 | 76.3 | 72.9 | 74.0 | 74.0 | 75.7 | 73.0 |
| | | 5.0 mm point hardness | 74.8 | 76.4 | 73.3 | 74.0 | 74.2 | 75.8 | 72.9 |
| | | 7.5 mm point hardness | 74.8 | 76.3 | 73.7 | 73.9 | 73.8 | 75.8 | 72.7 |
| | | 10.0 mm point hardness | 75.0 | 75.9 | 74.3 | 74.3 | 74.2 | 75.5 | 72.9 |
| | | 12.5 mm point hardness | 75.6 | 75.8 | 74.9 | 74.7 | 74.4 | 75.4 | 73.3 |
| | | 15.0 mm point hardness | 76.0 | 75.9 | 75.4 | 75.8 | 75.5 | 75.3 | 74.2 |
| | | Surface hardness Hs | 74.1 | 73.4 | 75.0 | 76.9 | 76.9 | 75.0 | 75.0 |
| | | Hardness difference (Hs − Ho) | −0.6 | −2.8 | 2.2 | 3.0 | 3.1 | −0.6 | 2.4 |
| | Compression deformation amount (mm) | | 3.3 | 3.3 | 3.3 | 3.3 | 3.3 | 3.3 | 3.3 |
| Property | Mass (g) | | 45.7 | 45.8 | 45.8 | 45.9 | 45.7 | 45.7 | 45.6 |
| | Compression deformation amount (mm) | | 2.8 | 2.8 | 2.8 | 2.8 | 2.8 | 2.8 | 2.8 |
| | Ball initial velocity (m/sec) | HS 40 m/sec | 56.73 | 56.76 | 56.72 | 56.63 | 56.67 | 56.67 | 56.66 |
| | | HS 50 m/sec | 71.00 | 71.00 | 71.00 | 71.00 | 71.00 | 71.00 | 71.00 |

BR730: high-cis polybutadiene (cis-1,4 bond amount = 96 mass %, 1,2-vinyl bond amount = 1.3 mass %, Moony viscosity ($ML_{1+4}$ (100° C.)) = 55, molecular weight distribution (Mw/Mn) = 3) JSR Corporation
Zinc acrylate: "ZN-DA90S" available from Nihon Joryu Kogyo Co., Ltd.
Zinc oxide: "Ginrei R" available from Toho Zinc Co., Ltd.
Dicumyl peroxide: "PERCUMYL (registered trademark) D" available from NOF Corporation
2-Thionaphthol: available from Tokyo Chemical Industry Co., Ltd.
Barium sulfate: "Barium sulfate BD" available from Sakai Chemical Industry Co., Ltd.

(2) Production of cover

Next, according to the formulation shown in Table 3, the cove materials were extruded with a twin-screw kneading extruder to prepare the cover compositions in a pellet form. The extruding conditions were a screw diameter of 45 mm, a screw rotational speed of 200 rpm, and screw L/D=35, and the mixture was heated to 150 to 230° C. at the die position of the extruder. The obtained cover composition was injection molded onto the spherical core obtained above to form the cover (thickness: 1.5 mm).

TABLE 3

| Cover composition | | |
|---|---|---|
| Formulation (parts by mass) | Himilan 1605 | 50 |
| | Himilan 1706 | 50 |
| | Titanium oxide | 4 |
| Slab hardness (Shore D) | | 65 |

The golf balls No. 1 to 3 are the cases where the rubber composition for forming the spherical core contains (x) a crosslinked rubber powder, and (x) the crosslinked rubber powder is formed from a rubber composition containing (r) a resin component. These golf balls No. 1 to 3 have an initial velocity of at least 56.7 m/sec (at a head speed of 40 m/sec).

The golf ball No. 4 is the case where the rubber composition for forming the spherical core does not contain a crosslinked rubber powder. The golf balls No. 5 and No. 6 are the cases where the rubber composition for forming the spherical core contains a crosslinked rubber powder, and the crosslinked rubber powder is formed from a rubber composition not containing a resin component. The golf ball No. 7 is the case where a resin not having a benzene ring in the molecule is blended in the rubber composition for forming the crosslinked rubber powder. These golf balls No. 4 to 7 have an initial velocity of less than 56.7 m/sec (at a head speed of 40 m/sec).

This application is based on Japanese patent application No. 2015-152347 filed on Jul. 31, 2015, the contents of which are hereby incorporated by reference.

The invention claimed is:

1. A golf ball comprising a spherical core and at least one cover layer covering the spherical core, wherein the spherical core is formed from a core rubber composition containing (a) a base rubber, (b) a co-crosslinking agent, (c) a crosslinking initiator and (x) a crosslinked rubber powder;

(x) the crosslinked rubber powder is formed from a rubber composition containing (a1) a base rubber, (b1) a co-crosslinking agent, (c1) a crosslinking initiator and (r) a resin component; and (r) the resin component includes a novolac type phenol resin, a coumarone-indene resin, a polystyrene resin, an acrylonitrile-butadiene-styrene copolymer resin, an acrylonitrile-styrene resin, or a polyethylene terephthalate resin.

2. The golf ball according to claim 1, wherein (x) the crosslinked rubber powder has a Lupke type rebound resilience ranging from 30% to 99%.

3. The golf ball according to claim 1, wherein (x) the crosslinked rubber powder has a hardness ranging from 15 to 95 in Shore C hardness.

4. The golf ball according to claim 1, wherein (x) the crosslinked rubber powder has a volume average particle size ranging from 200 μm to 900 μm.

5. The golf ball according to claim 1, wherein (r) the resin component has a softening point of 90° C. or less.

6. The golf ball according to claim 1, wherein (r) the resin component is a novolac type phenol resin or a coumarone-indene resin.

7. The golf ball according to claim 1, wherein the core rubber composition contains (x) the crosslinked rubber powder in an amount ranging from 2.1 parts by mass to 30 parts by mass with respect to 100 parts by mass of (a) the base rubber.

8. The golf ball according to claim 1, wherein the rubber composition for forming (x) the crosslinked rubber powder contains (r) the resin component in an amount ranging from 1 part by mass to 50 parts by mass with respect to 100 parts by mass of (a1) the base rubber.

9. The golf ball according to claim 1, wherein the core rubber composition further contains (d) a carboxylic acid and/or a salt thereof.

10. The golf ball according to claim 1, wherein the core rubber composition further contains (f) an organic sulfur compound.

11. The golf ball according to claim 1, wherein the rubber composition for forming (x) the crosslinked rubber powder further contains (f1) an organic sulfur compound.

12. The golf ball according to claim 6, wherein (r) the resin component is a novolac type phenol resin, and the novolac type phenol resin is a cashew oil modified novolac type phenol resin.

13. The golf ball according to claim 6, wherein (r) the resin component is a coumarone-indene resin, and a monomer component for forming the coumarone-indene resin contains coumarone or a derivate thereof in an amount ranging from 1 mass % to 20 mass %, and indene or a derivate thereof in an amount ranging from 40 mass % to 95 mass %.

14. The golf ball according to claim 1, wherein the spherical core has a center hardness ranging from 35 to 90 in Shore C hardness.

15. The golf ball according to claim 1, wherein the spherical core has a surface hardness ranging from 65 to 95 in Shore C hardness.

16. The golf ball according to claim 1, wherein the spherical core has a hardness difference between a surface hardness and a center hardness thereof ranging from −10 to 10 in Shore C hardness.

17. The golf ball according to claim 1, wherein the spherical core has a compression deformation amount ranging from 2.0 mm to 6.0 mm, when applying a load from an initial load of 98 N to a final load of 1275 N to the spherical core.

18. The golf ball according to claim 1, wherein the golf ball has a compression deformation amount ranging from 2.0 mm to 5.0 mm, when applying a load from an initial load of 98 N to a final load of 1275 N to the golf ball.

19. The golf ball according to claim 1, wherein the rubber composition for forming (x) the crosslinked rubber powder contains (r) the resin component in an amount ranging from 1 part by mass to 50 parts by mass with respect to 100 parts by mass of (a1) the base rubber, and (x) the crosslinked rubber powder has a Lupke type rebound resilience ranging from 30% to 99%.

20. The golf ball according to claim 1, wherein the core rubber composition contains (x) the crosslinked rubber powder in an amount ranging from 2.1 parts by mass to 30 parts by mass with respect to 100 parts by mass of (a) the base rubber, the rubber composition for forming (x) the crosslinked rubber powder contains (r) the resin component in an amount ranging from 1 part by mass to 50 parts by mass with respect to 100 parts by mass of (a1) the base rubber, and (x) the crosslinked rubber powder has a Lupke type rebound resilience ranging from 30% to 99%.

* * * * *